US011101578B2

(12) United States Patent
Kwok

(10) Patent No.: US 11,101,578 B2
(45) Date of Patent: Aug. 24, 2021

(54) IN-LINE SWITCH ASSEMBLY

(71) Applicant: Ka Kin Kwok, Hong Kong (HK)

(72) Inventor: Ka Kin Kwok, Hong Kong (HK)

(73) Assignee: Ka Kin Kwok, Hong Kong (HK)

( * ) Notice: Subject to any disclaimer, the term of this patent is extended or adjusted under 35 U.S.C. 154(b) by 0 days.

(21) Appl. No.: 16/785,113

(22) Filed: Feb. 7, 2020

(65) Prior Publication Data

US 2021/0126381 A1 Apr. 29, 2021

(30) Foreign Application Priority Data

Oct. 25, 2019 (HK) ..... HK19131535.7
Jan. 13, 2020 (HK) ..... HK32020001322.7

(51) Int. Cl.
*H01H 23/04* (2006.01)
*H01R 4/2404* (2018.01)
*H01H 23/24* (2006.01)

(52) U.S. Cl.
CPC ..... *H01R 4/2404* (2013.01); *H01H 23/04* (2013.01); *H01H 23/24* (2013.01)

(58) Field of Classification Search
CPC ..... H01H 9/0228; H01H 1/585; H01H 13/81; H01H 9/02; H01H 23/143; H01H 23/205; H01H 23/04; H01H 23/20; H01H 23/24; H01H 23/14; H01R 4/2404; H01R 13/506; H01R 4/2433; H01R 4/64; H01R 4/24; H01R 4/2412; H01R 4/2416; H01R 4/242; H01R 4/2429; H01R 4/28
See application file for complete search history.

(56) References Cited

U.S. PATENT DOCUMENTS 4,820,190 A 4/1989 Humphrey
5,854,456 A 12/1998 Lee-ven
(Continued)

FOREIGN PATENT DOCUMENTS

DE 19930044 A1 1/2001
EP 0725411 A2 8/1996
(Continued)

OTHER PUBLICATIONS

European Search Report and written opinion for corresponding EP patent application No. 20175777.0, dated Nov. 9, 2020.
(Continued)

*Primary Examiner* — Ahmed M Saeed

(57) ABSTRACT

An in-line switch assembly comprising a housing and two ports at different parts of the housing for insertion of an end of a power cord into the housing. The housing has first and second housing parts. A connection mechanism is provided in each of the ports, adapted to receive an end of a power cord, and is operable to cause piercing of a piercing part through a sheath of a power cord and then electrical contact with a conductive core of the power cord. The housing is configured to undergo from a first state in which the first and second housing parts are partially attached together, thereby allowing insertion of an end of a power cord through each of the ports to the respective connection mechanism, to a second state in which the first and second housing parts are fully attached together, with an inserted end of a said power cord being acted upon by the connection mechanism.

16 Claims, 8 Drawing Sheets

(56) References Cited

U.S. PATENT DOCUMENTS

| | | | | |
|---|---|---|---|---|
| 6,005,210 | A * | 12/1999 | Chien | H01H 1/585 200/14 |
| 6,236,006 | B1 | 5/2001 | Wecke | |
| 6,255,613 | B1 | 7/2001 | Yang | |
| 2005/0287863 | A1 | 12/2005 | Tufano et al. | |
| 2015/0207240 | A1 | 7/2015 | Olson et al. | |
| 2015/0207246 | A1 | 7/2015 | Lewis | |
| 2016/0329668 | A1 | 11/2016 | Hestrin | |

FOREIGN PATENT DOCUMENTS

| | | | |
|---|---|---|---|
| EP | 2530692 | A1 | 12/2012 |
| FR | 1254889 | A | 2/1961 |

OTHER PUBLICATIONS

Chinese Search Report for corresponding HK patent application No. 19131535.7, dated Apr. 16, 2020.

* cited by examiner

IN-LINE SWITCH ASSEMBLY

The present invention relates to an electrical switch, in particular, an in-line switch for installing or retrofitting to a power cord of an electrical appliance.

BACKGROUND OF THE INVENTION

In-line switches are widely known and used in electrical appliances, for example, desk lamps, to provide connection or interruption of electrical current to the electrical appliance. Typically, an in-line switch is electrically connected to a power cord of the electrical appliance. However, it remains a concern with the prior art in-line switches that preparatory work on the power cord, for example, stripping the cord to expose the wire leads, will be required before connecting to the in-line switch. Another drawback of the prior art in-line switches would be the complication resulting from having to manually mount the conductive cores of the power cord and assemble the in-line switch, in which technical skills and tools are often required to complete the installation. Yet another shortcoming associated with the prior art in-line switches is that these in-line switches are designed to only accept specific size of electrical wires to be connected. A need therefore exists for an in-line switch that is simple and safe to install, yet can be used with electrical wires of different sizes, within a limited size range.

SUMMARY OF THE INVENTION

The present invention seeks to address the problems or at least alleviates the aforementioned drawbacks by providing an improved in-line switch assembly comprising:

a housing having a first housing part and a second housing part attachable together to form the housing;

two ports at different parts of the housing for insertion of an end of a power cord into the housing;

a conductor provided in each of the ports, each conductor having a piercing part;

a switching mechanism provided between the conductors of the respective ports for making and breaking electrical connection between the conductors; and a connection mechanism provided in each of the ports and adapted to receive an end of a power cord, operable to cause piercing of the piercing part through a sheath of the power cord and then electrical contact with a conductive core of the power cord, wherein the housing is configured to undergo from a first state in which the first and second housing parts are partially attached together, thereby allowing insertion of an end of a power cord through each of the ports to the respective connection mechanism, to a second state in which the first and second housing parts are fully attached together, with an inserted end of a said power cord being acted upon by the connection mechanism.

In one embodiment, the piercing part forms as an extension to the conductor.

In another embodiment, a positioning portion is provided in each of the ports, and is adapted to restrict lateral movement of the inserted end of a said power cord.

In one embodiment, the positioning portion comprises a recess having a cross-section profile substantially complementary to a cross-section profile of the power cord.

Preferably, the recess is a U-shape channel having a center rib extending longitudinally.

In one embodiment, the connection mechanism comprises a plurality of pressing members arranged along a length of the inserted end of a said power cord.

In another embodiment, the connection mechanism comprises a plurality of gripping members, configured to apply pressure on the end of a said power cord during the second state.

Preferably, the pressing members are oppositely and alternatively arranged on the first housing part and the second housing part.

More preferably, serrations are provided on each of the plurality of gripping members.

In one embodiment, the piercing part comprises at least one piercing portion configured to cause the sheath of the power cord to be pierced.

Preferably, an aligning member is provided and configured to provide a biasing force to cause a wire within the power cord to abut against the center rib.

In an embodiment, in the first state the first housing part is slidably movable with respect to the second housing part through a slidable engagement between a plurality of snap hooks arranged on the second housing part and a plurality of complementary elongated slots arranged on the first housing part.

In another embodiment, in the second state the first housing part is secured to the second housing part by an interference fit formed between a plurality of protrusions arranged on the first housing part and a plurality of complementary apertures arranged on the second housing part.

Preferably, a guard member is provided for each of the ports for blocking the end of a said power cord from reaching further to the switching mechanism.

In one embodiment, the power cord is a twin-lead power cord.

In another embodiment, a divider is arranged in the positioning portion for separating a live wire and a neutral wire within the positioning portion.

In one embodiment, in the first state the first housing part is slidably movable with respect to the second housing part along a direction of coupling.

In another embodiment, the ports are positioned opposite each other.

In yet another embodiment, the in-line switch is a double-pole single throw switch.

In one embodiment, the switching mechanism comprises one of the following switches: a rocker switch, a tactile switch, a push-button switch, a slide switch or a rotary switch.

DESCRIPTION OF THE DRAWINGS

The present invention will now be described more specifically by way of example only with reference to the accompanying drawings in which.

DETAILED DESCRIPTION OF EMBODIMENTS

The following clearly and completely describes the technical solutions in the embodiments of the present invention with reference to the accompanying drawings. Apparently, the described embodiments are merely some but not all of the embodiments of the present invention. All other embodiments based on the embodiments of the present invention and obtained by a person of ordinary skill in the art without investing creative efforts shall fall within the scope of the present invention.

Figure 1:
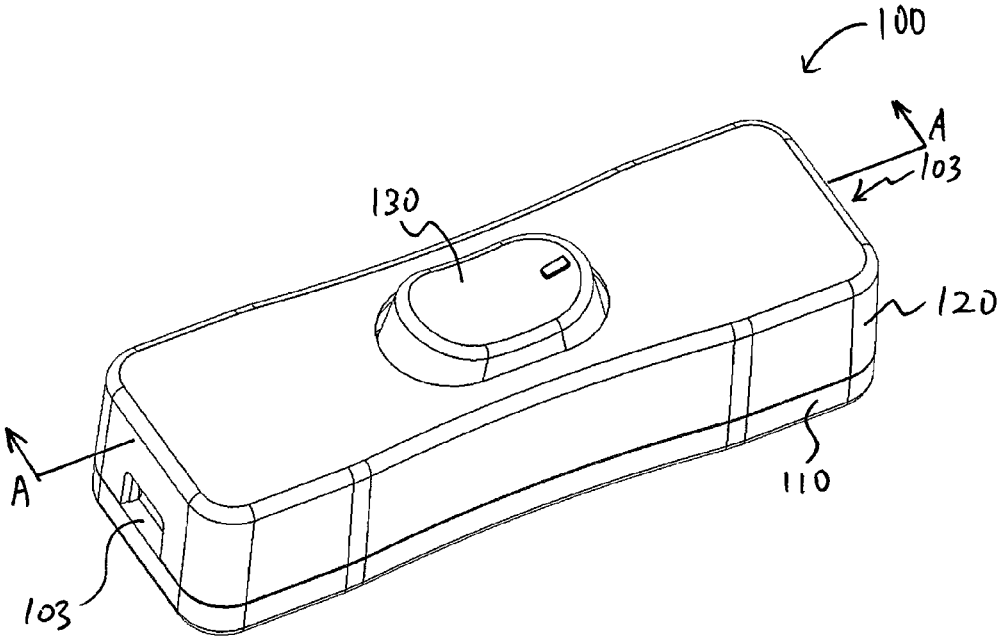
FIG. 1 is a perspective view of an in-line switch assembly according to an embodiment of the present invention.

Referring to FIG. 1 of the accompanying drawings, an in-line switch assembly 100 embodying the present invention is shown. According to the present invention, the in-line switching assembly 100 is constructed in such a way that a user may install or retro-fit the in-line switch assembly to an electricity supplying cord of an electrical appliance, for a typical example, a lamp, without requiring any tool.

Generally, according to an embodiment of the present invention, the in-line switch assembly 100 includes a switch housing 110, 120 comprising a first housing part and a second housing part, in this exemplary embodiment, an upper housing 120 and a lower housing 110. The switching assembly further includes a switching mechanism 130, for example, a rocker switch. The switching mechanism can be accessible by the user through a cut-out provided on the switch housing 110, 120. Basically, the switch housing 110, 120 serve to enclose various internal components which will be discussed in details in the following.

As shown in FIG. 1, the in-line switch assembly 100 includes two ports 103 each configured for receiving an end of a power cord 10. For example, the two ends 10 can be obtained by cutting the power cord into two portions, for example, one portion that physically connects to the electrical appliance, and another portion that physically connects to a power plug (not shown in the figures). According to FIG. 1, the ports 103 are located opposite to each other along a longitudinal direction of the in-line switch assembly 100. Alternatively, the ports 103 may be on same side of the assembly 100. In another embodiment, there can be more than two ports 103, subjected to different cabling requirements.

Figure 2:
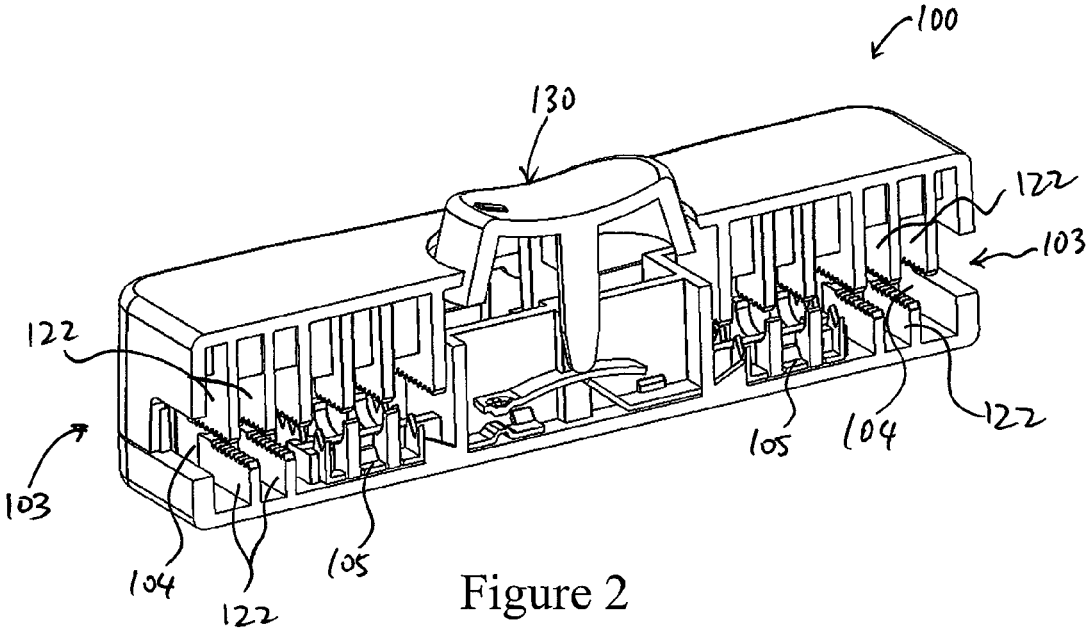
FIG. 2 is a sectioned view taken along line A-A of the in-line switch assembly in FIG. 1.
Figure 3:
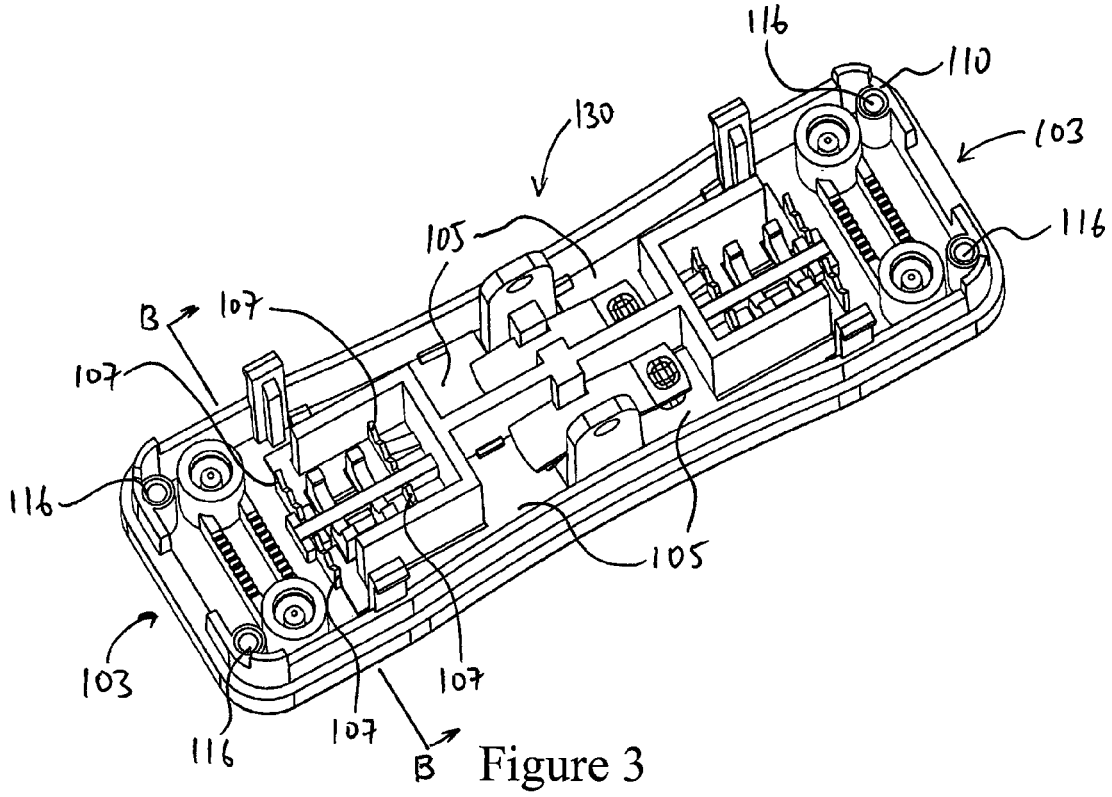
FIG. 3 is a perspective view of the in-line switch assembly in FIG. 1 with the first housing part removed.

FIG. 2 shows a sectioned view of the in-line switch assembly 100 along line A-A shown in FIG. 1. Inside each of the ports 103, an interior space 104 is provided and is jointly formed by the upper housing 120 and the lower housing 110. One or more conductors 105, provided inside each of the ports 103, electrically connects to the switching mechanism 130. In this exemplary embodiment which embodies a double pole in-line switch, two conductors 105 are arranged in each of the ports 103. The switching mechanism 130 controls the connection state between the conductors 105 in each of the two ports 103. Alternatively, the in-line switch assembly 100 may have a single-pole configuration in which the switching mechanism 130 controls the connection state between a single pair of conductors 105 (i.e., one in each port 103). According to a double-pole configuration as shown, the switching mechanism 130 controls the connection state of two separate pairs of conductors 105 (i.e., two in each port). FIG. 3 shows an internal perspective view of the switch assembly 100 having a double-pole configuration according to the present embodiment. Preferably, the conductor 105 is made from, for example, metal stampings. Optionally, the in-line switch assembly 100 may have one or more switching mechanisms 130 for controlling the connection states of multiple ports.

Figure 4:
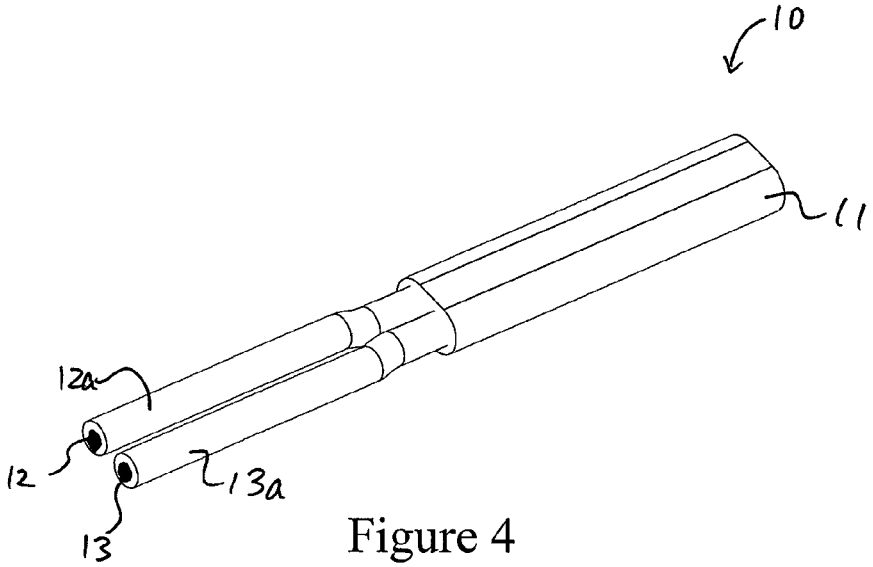
FIG. 4 is a perspective view of a twin-wire power cord for use with the in-line switch assembly in FIG. 1.

Specifically, the end of power cord 10 receivable in each of the ports 103 is a twin-wire type power cord, as shown in FIG. 4. This type of power cord has an outer sheath 11 molded around two wires, namely a live wire 12 and a neutral wire 13, which are placed adjacent each other. Each of the live wire 12 and the neutral wire 13 has a conductive core surrounded by an inner sheath 12*a*, 13*a*, and are enclosed within the outer sheath 11.

Figure 5:
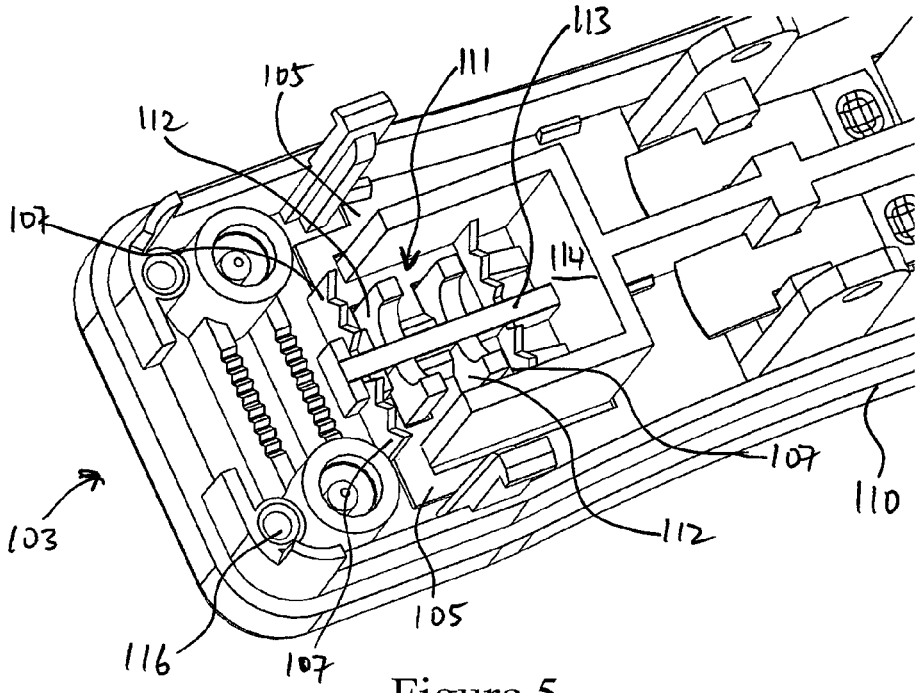
FIG. 5 is a detailed internal view of the port of the in-line switch assembly.

As FIG. 5 shows, inside each of the ports 103 there is provided a positioning portion 111. The positioning portion 111 serves as a positioning means for receiving and positioning the end of the power cord 10. Basically, the positioning portion 111 prevents lateral movements of the end of the power cord inserted in the port as the connection mechanism 101 operates. According to the present embodiment, the positioning portion 111 is a recess having a U-shape cross-section profile complementary to a cross-section profile of the power cord. In this specific embodiment, the positioning portion 111 has a plurality of webs 112 each having a U-shape cutout. As can be seen in FIG. 5, the webs 112 are spaced apart by a distance. A center supporting rib 113 is provided longitudinally across the center of the webs 112 at the lowest point of the U-shape cutout. The center supporting rib 113 provides an abutting surface for supporting the power cord 10 along an axial direction.

Figure 6:
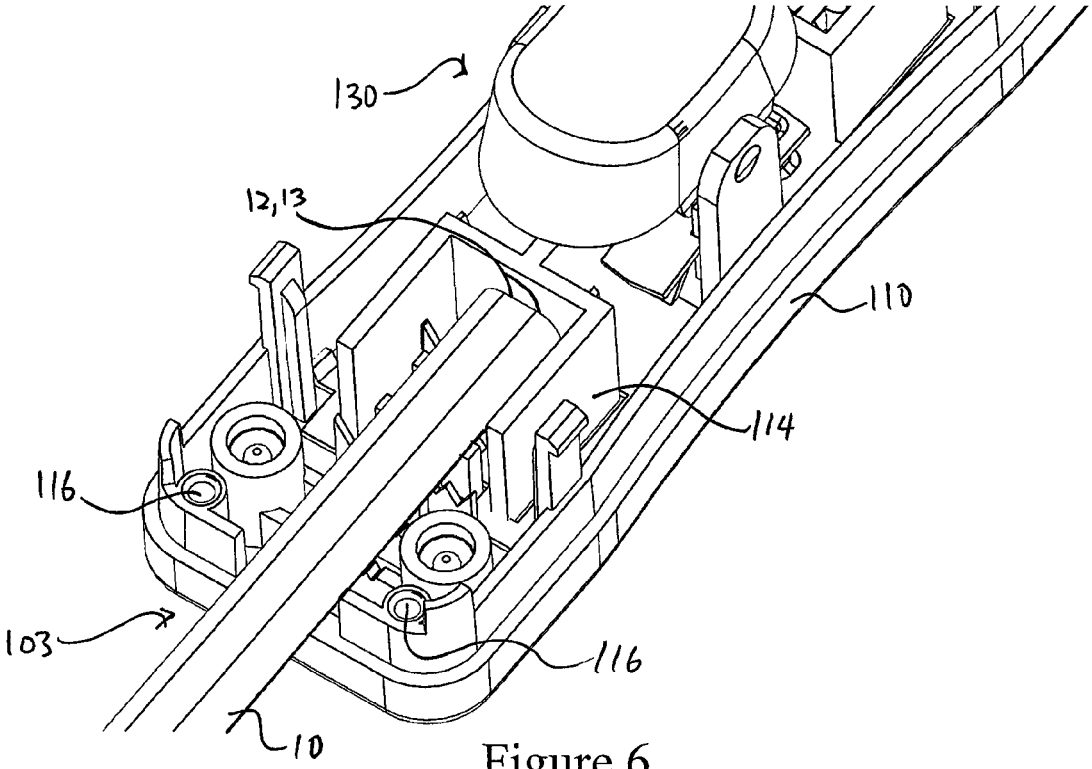
FIG. 6 shows the port as shown in FIG. 5 inserted with the power cord.

Advantageously, a guard member 114 is provided for each of the ports 103. The guard member 114 essentially serves to limit the insertion length of the power cord 10 into the port 103. As specifically shown in FIG. 5, the guard member 114 is constructed as a wall structure that partially surrounds the positioning portion 111. The guard member 114 basically blocks the end of the power cord 10 from moving further into the port 103. The guard member 114 also serves to insulate the conductive cores of the power cord 10, which may be exposed at the tip of the end of the power cord 10, from the switching mechanism. As specifically shown in FIG. 6, the guard member 114 comprises a three-sided wall partially surrounding the positioning portion 111 where the end of the power cord 10 is received and positioned. The three-sided wall of the guard member 114 essentially separates and insulates the conductive cores of the live wire and the neutral wire 13 from reaching further into the switching mechanism 130.

Figure 7:
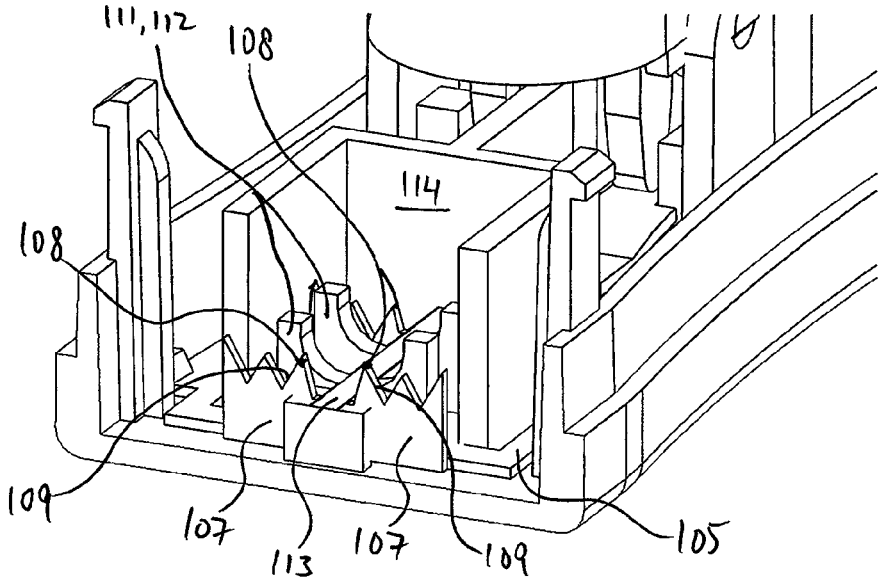
FIG. 7 is a sectioned view taken along line B-B in FIG. 3, showing the details of the positioning portion.

Referring to FIG. 3 and FIG. 5, each conductor 105 is provided with at least one piercing part 107, in this case, each conductor 105 has two piercing parts 107. Specifically, each of the piercing parts 107 forms as an extension of the conductor 105 which is bent upward at a substantially right angle. The piercing parts 107 are positioned at the bottom of the positioning portion 111. Preferably, each of the piercing parts 107 is positioned and aligned such that a piercing portion 108 of the piercing part 107 would interfere with the power cord 10 when it is being placed in the positioning portion 111. According to FIG. 7, the piercing portion 108 has a shape resembling a sharp spike, and serves to cause piercing of the piercing part 107 through the sheaths (i.e., the outer sheath 11 and inner sheaths 12*a*, 13*a* of the power cord 10) when pressure is applied on the power cord 10 toward the piercing part 107. The piercing part 107 further has a cutting edge portion 109 which serves to slice open the sheaths 11, 12*a*, 13*a* after the piercing portion 108 has pierced through the sheaths. Consequently, the piercing portion 108 and/or the cutting edge portion 109 will make contact with the conductive core 12, 13, thereby establishing electrical connection.

As shown, there can be more than one piercing part 107 positioned along the axial length of the power cord 10 within each of the ports 103. In this example of a double-pole in-line switch, there are provided two piercing parts 107 for each of the two conductors 105. Advantageously, the piercing parts 107 are supported by at least one supporting member 109 to help maintain an upright position for maximizing piercing effect on the power cord 10.

Figure 8A:
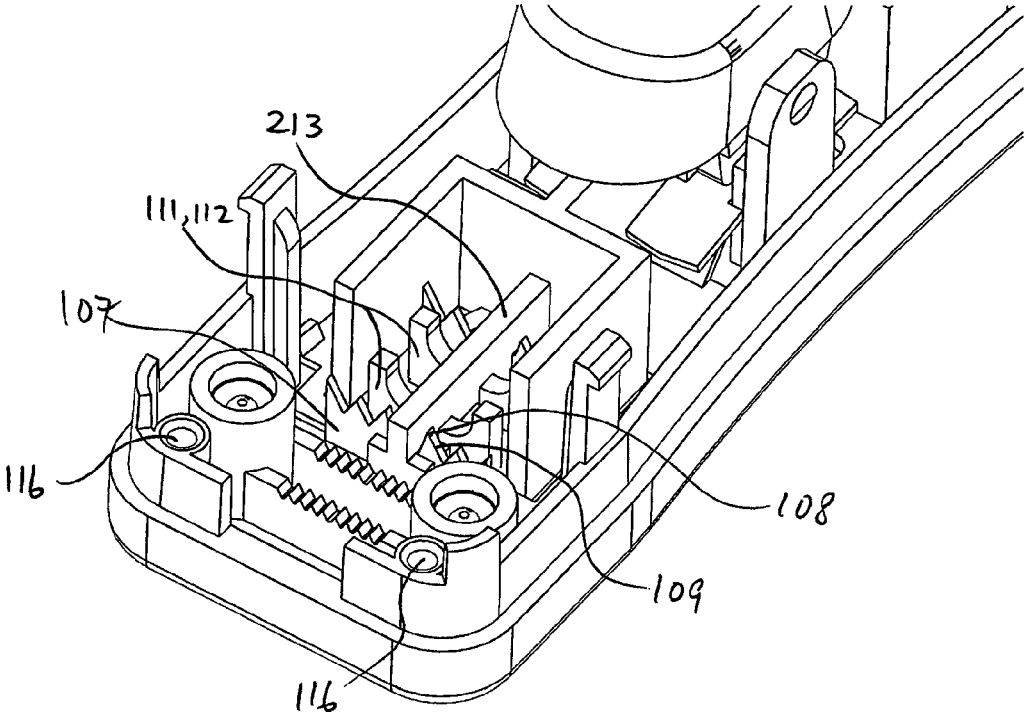
FIG. 8*a* is a detailed internal view of the in-line switch assembly according to an alternative embodiment.
Figure 8B:
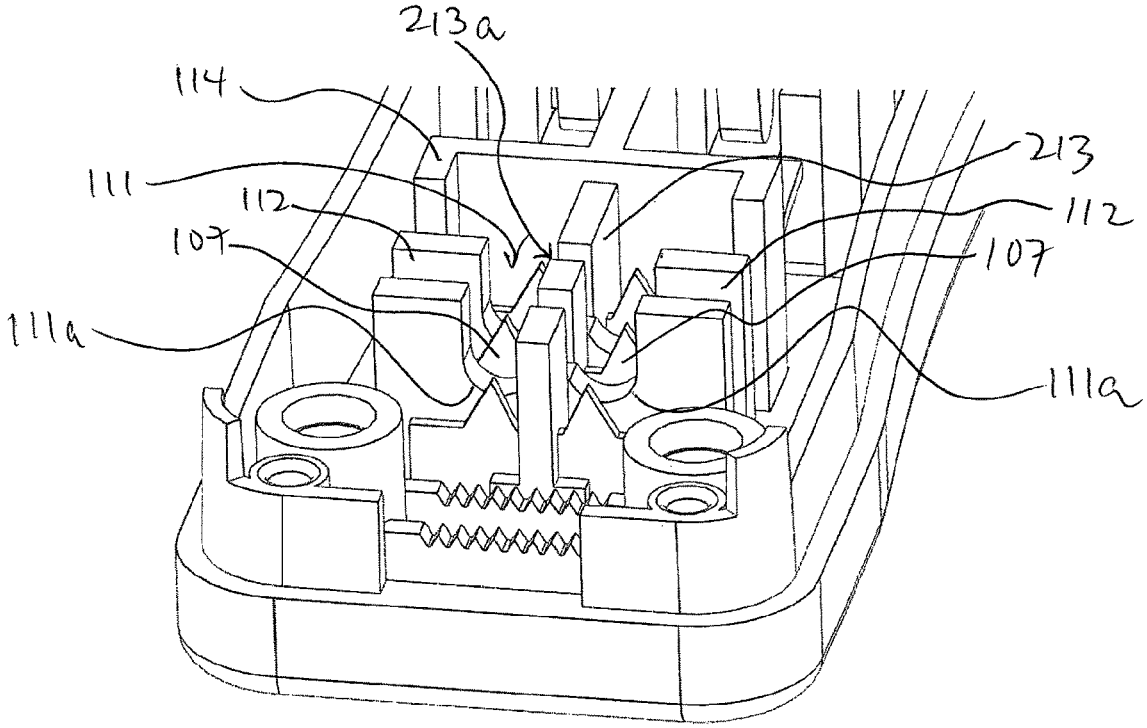
FIG. 8*b* is a detailed internal view of the in-line switch assembly according to another alternative embodiment.
Figure 9:
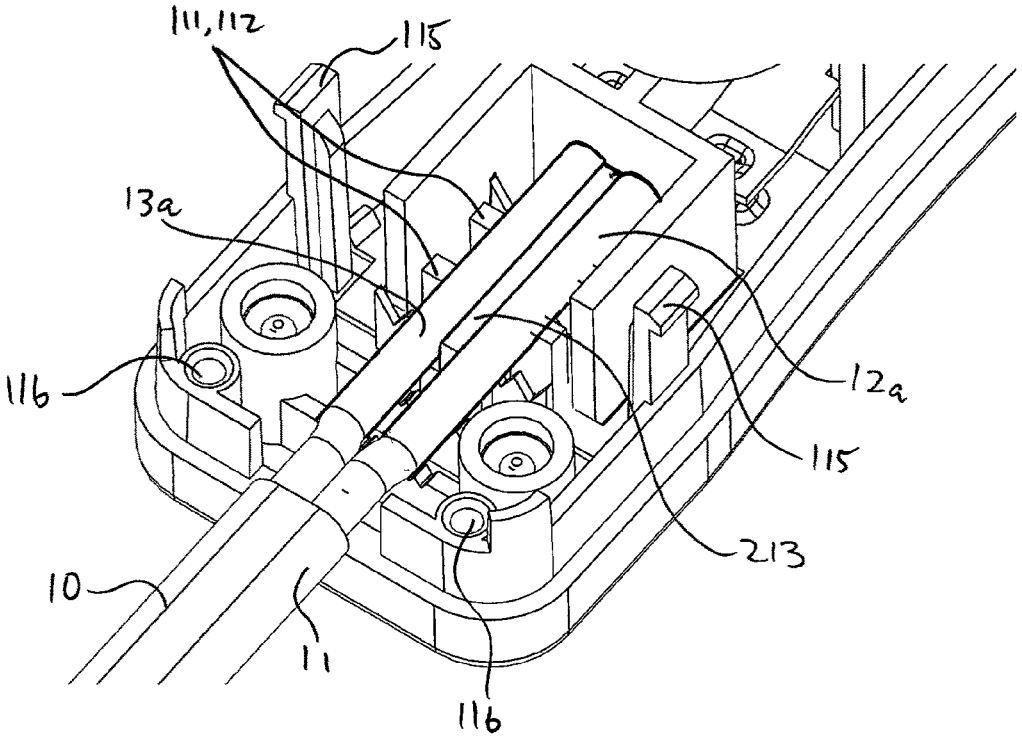
FIG. 9 shows the power cord inserted into the in-line switch assembly according to FIG. 8*a,*

In an alternative embodiment, the positioning portion 111 is provided with an elevated center rib 213 that protrudes upwardly and divides the positioning portion 111 into two partitions, each for the live wire 12 and the neutral wire 13, as shown in FIG. 8*a* and FIG. 9. Basically, placing the live and neutral wires 12, 13 in the positioning portion 111 would require the outer sheath 11 of the power cord 10 be stripped and removed before inserting into the positioning portion 111. It should be understood that the cross-section profile of the positioning portion 111 and the positions of the piercing parts 107 can be changed to accommodate different types and sizes of power cord 10. According to another alternative embodiment as shown in FIG. 8*b*, the positioning portion 111 has a different cross-section profile, featuring two substantially U-shape recesses 111*a*, each for receiving the live wire 12 and the neutral wire 13. As shown, the webs 112 of the positioning portion 111 and the elevated center rib 213 have a height that is substantially the same as the guard member 114. The extra height of the webs 112 provides the U-shape recesses 111*a* with a deepened depth for receiving the live wire 12 and the neutral wire 13. Similarly, piercing parts 107 are provided at the bottom of the U-shape recesses 111*a*. Cutouts 213*a* are provided on the elevated center rib 213 at positions where the pressing members 121 of the upper housing to engage therebetween and press on the live wire 12 and the neutral wire 13, as the connection mechanism 101 engages.

Figure 8C:
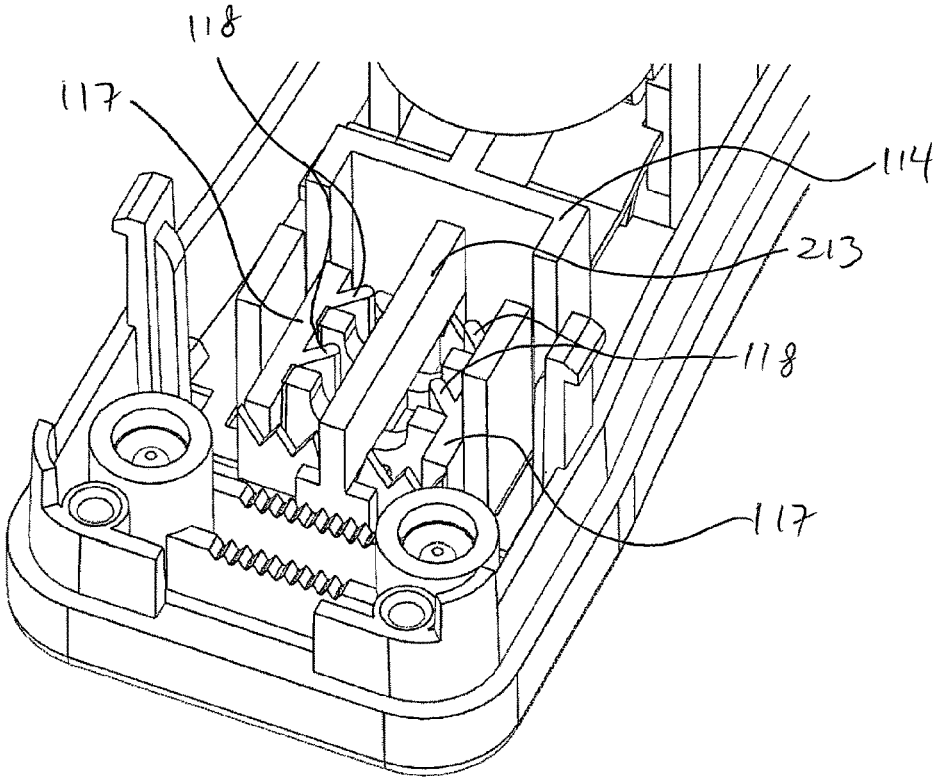
FIG. 8*c* is a detailed internal view of the in-line switch assembly according to yet another alternative embodiment.

In a more preferred alternative embodiment as shown in FIG. 8*c*, the in-line switch assembly 100 further includes two aligning members 117, each provided for aligning each of the live wire 12 or the neutral wire 13 by abutting the wires against the elevated center rib 213. At least one biasing arm 118 is provided on each of the aligning members 117. The at least one biasing arm 118 extends toward the elevated center rib 213, at an angle toward the inside of the port. The aligning members 117 may be made out of flexible material so that the at least one biasing arm 118 exerts a biasing force to each of the wires 12, 13, causing the wires 12, 13 to abut against the elevated center rib 213 once the wires 12, 13 are inserted into the positioning portion 111.

Each of the aligning members 117 may be an individual component configured for different sizes of power cord to be received in the positioning portion 111. In an embodiment, the aligning members 117 of a different configuration (i.e., with biasing arms 118 of a different length) may be installed in order for the in-line switch assembly to accept a power cord of a specific type or size, or a range of slightly different sizes, while maintaining each of the wires 12, 13 in the respective positions for the connection mechanism 101 to engage. With the live wire 12 and the neutral wire 13 being biased against the elevated center rib 213, the wires would less likely be displaced when being pressed against the positioning portion 111 by the pressing members 121 as the connection mechanism 101 engages. As a result, the precision of wire piercing can be optimized.

Figure 10:
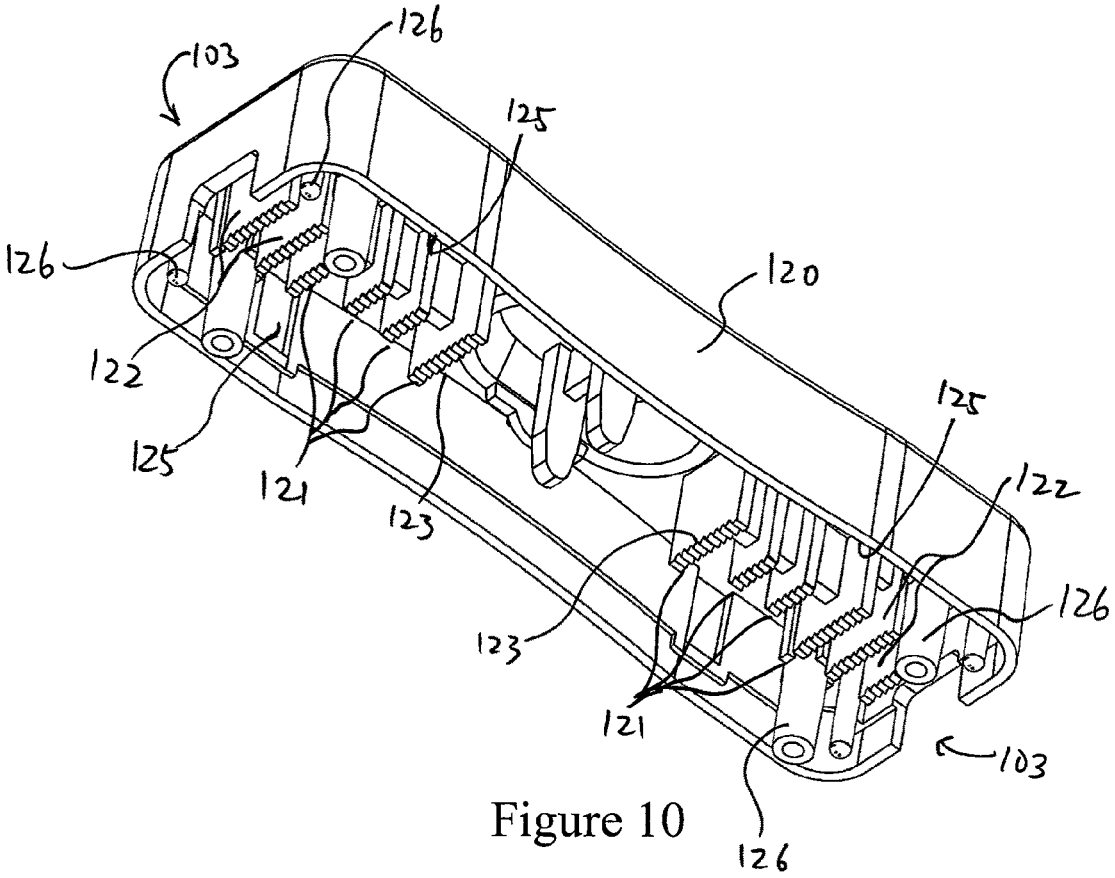
FIG. 10 is a bottom perspective view showing the first housing part.

Moving on to FIG. 10 which shows a view of the upper housing according to an embodiment, a plurality of pressing members 121 is provided at each of the ports 103. Preferably, the pressing members 121 are formed on the upper housing 120 and extended toward the lower housing 110. The pressing members 121 are positioned in order to contact with the power cord 10 when the upper housing 120 engages and couples to the lower housing 110. Specifically, the pressing members 121 are lateral webs positioned perpendicularly to the length of the power cord 10 to be received in the port 103. Advantageously, each of the pressing members 121 is provided with serrations.

The principle of the connection mechanism 101 will be described in the following. The connection mechanism 101 essentially includes the positioning portion 111, the pressing members 121, and the piercing part 107. Basically, the connection mechanism 101 operates in an unengaged state in which the end of the power cord 10 is insertable into the positioning portion 111, and an engaged state in which the end of the power cord 10 is pierced and secured in the port 103. In the engaged state, the ends of the power cord 10 are both electrically and mechanically connected with the in-line switch assembly.

The connection mechanism 101 engages when the upper housing 120 is pressed toward the lower housing 110, with a power cord inserted and positioned in the positioning portion 111 in each of the ports 103. On the upper housing 120, there are provided two pressing members 121 positioned in alignment with the positioning portion 111 on the lower housing 110, such that when the upper housing 120 is pressed against the lower housing 110, the pressing member 121 would exert a pressure on the power cord 10 inserted therein against the positioning portion 111, thereby forcing the piercing parts 107 to cause piercing of the piercing part through the sheaths of the power cord 10. Further movement of the upper housing 120 toward the lower housing 110 would eventually cause the piercing portions 108 to pierce through the outer sheath 11 and the inner sheath 121, 13*a* of the power cord 10 and make contact with the respective conductive cores of the live and neutral wires 12, 13.

Advantageously, a number of gripping members 122 are provided immediate the opening of the port 103 where the powers cord 10 passes through. The gripping members 122 are provided on both the upper housing 120 and the lower housing 110, and are arranged in an alternative fashion as shown in FIG. 2 and FIG. 10. As the connection mechanism engages, the pressure exerted on the power cord 10 by the gripping members produces a gripping effect which would securely maintain the power cord 10 in between the gripping members 122 of the upper and lower housings 120, 110. Optionally, each of the gripping members 122 may be provided with a gripping portion 123 having a serrated edge for an enhanced gripping effect on the power cord 10.

Figure 11A:
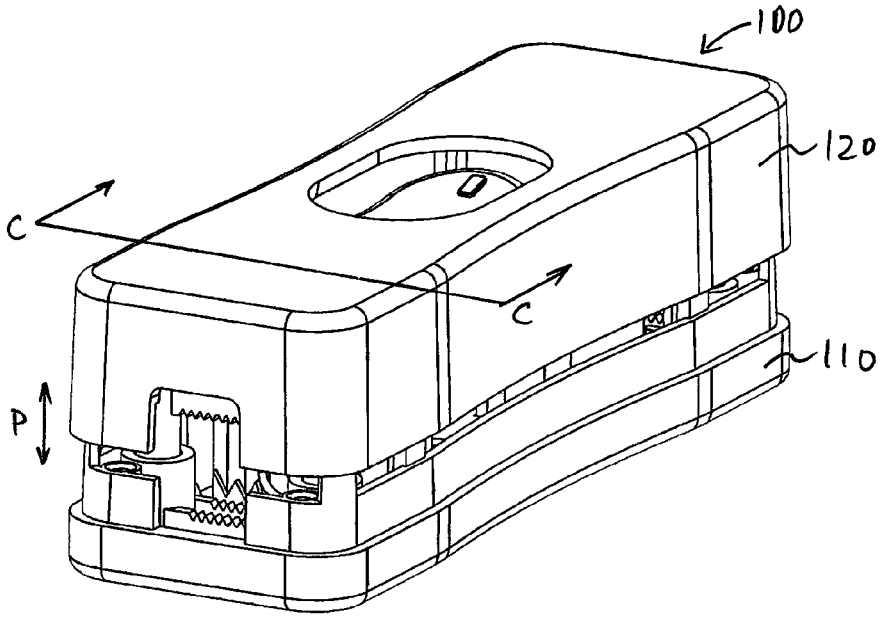
FIG. 11*a* is a perspective view showing the in-line switch assembly in a first state.
Figure 11B:
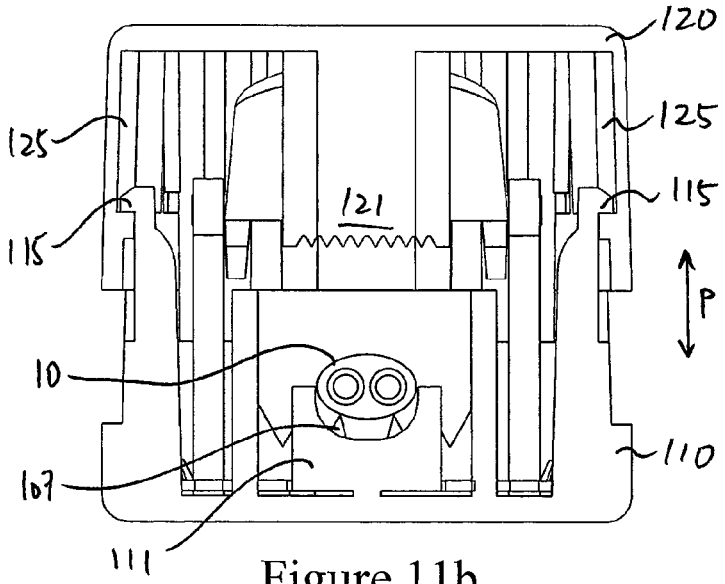
FIG. 11*b* is a sectioned view showing the connection mechanism inside the in-line switch assembly of FIG. 11*a;*

According to the present invention, the switch housing 110, 120 is configured to undergo a two-state engagement process, providing a simple, reliable, and tool-less installation of the in-line switch to a power cord. In a first state as shown in FIG. 11*a* and FIG. 11*b*, the upper housing 120 is partially and movably attached to the lower housing 110. Specifically, the lower housing 110 is provided with, for example, snap hooks 115 extending toward the upper housing 120. The snap hooks 115 are arranged to engage with complementary elongated slots 125 arranged inside the upper housing 120 (shown in FIG. 10). As shown, the upper housing 120 is pre-attached to the lower housing 110 with the snap hooks 115 situated within the corresponding elongated slots 125. The movement of the upper housing 120 is basically limited by the length of the elongated slots 125. Accordingly, the upper housing 120 is slidably attached to the lower housing 110, and movable with respect to the lower housing 110 in the direction P as indicated in FIG. 11*b*. The connection mechanism is now in the unengaged state.

The movable engagement between the snap hooks 115 and the elongated slots 125 allows the upper housing 120 to be slidably movable relative to the lower housing 110 to a certain extent. The elongated slots 125 provide a guiding effect for the snap hooks 115 to slidably move therein, at the same time, maintaining the required alignment between the two housings 110, 120 when being attached together. Furthermore, during the first state, a certain amount of play is provided between the pressing members 121 and the positioning portion 111, allowing the end of the power cord 10 to be insertable into each of the ports 103 and aligned with positioning portion 111. This can simplify the insertion and positioning of the end of the power cord within the port 103 by eliminating the need of taking apart the in-line switch assembly 100 (i.e., completely separating the upper housing 120 from the lower housing 110).

The upper housing 120 and the lower housing 110 are further provided with fastening pairs 116, 126. The fastening pairs 116, 126 provide a secure coupling between the two housings 110, 120 during the second state. As shown in FIG. 9 and FIG. 10, the fastening pairs 116, 126 comprise protrusions 126 (i.e., mounting posts, extended from the upper housing 120) insertable into corresponding recesses 116 (i.e., apertures) provided on the lower housing 110. During the second state, the upper housing 120 is pressed toward the lower housing 110, forcing each of the mounting posts 126 to insert into the corresponding apertures 116. The engagement of the fastening pairs 116, 126 generates a friction fit or interference fit therebetween, securely fastening the upper housing 120 with the lower housing 110.

Figure 12A:
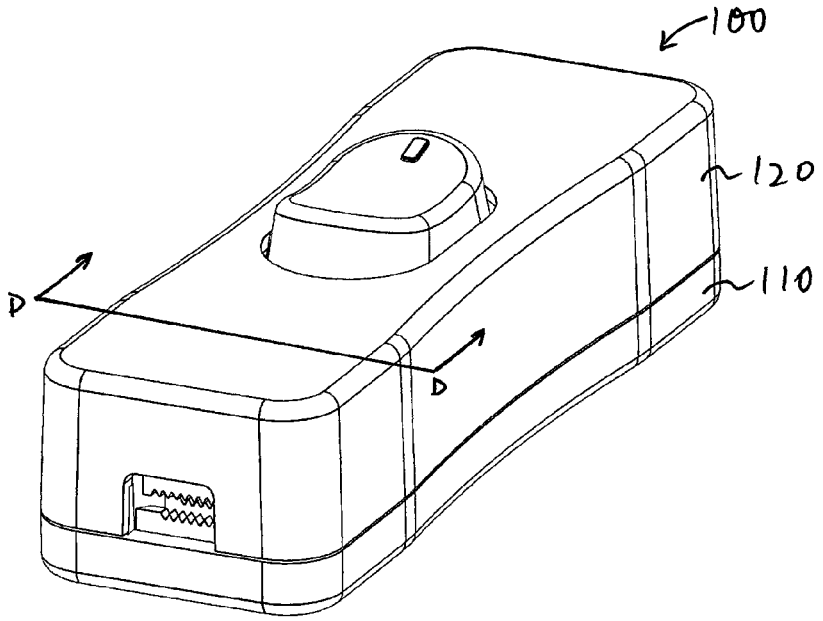
FIG. 12*a* is a perspective view showing the in-line switch assembly in a second state.
Figure 12B:
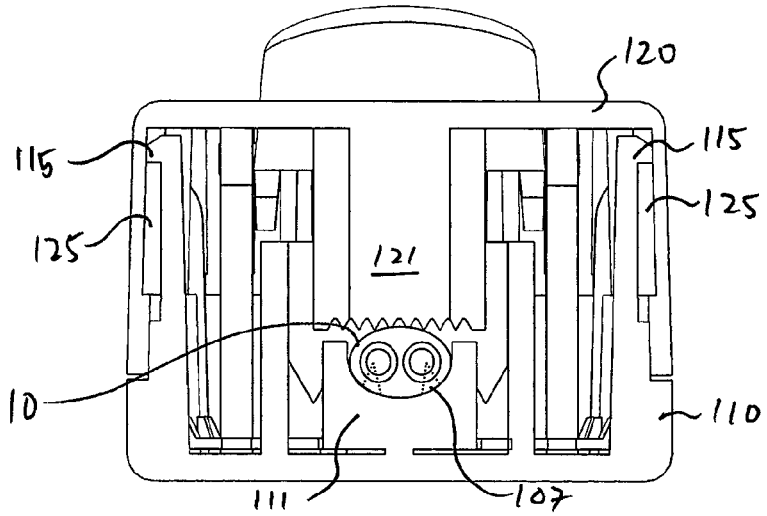
FIG. 12*b* is a sectioned view showing the connection mechanism inside the in-line switch assembly of FIG. 12*a.*

Referring to FIG. 12*a* and FIG. 12*b*, the switch assembly 100 is now in the second state, with the upper housing 120 completely attached to the lower housing 110. The second state also means that the connection mechanism is in its engaged state. As shown, the ends of the power cord 10 are pressed against the respective piercing parts 107. Accordingly, the sheaths 11, 12*a*, 13*a* of the electric cord 10 are pierced through by the piercing portions 108, thereby allowing the conductive cores to make electrical connection with the respective conductors 105, whilst mechanically securing the ends of the power cord 10 at the ports 103. Accordingly, this completes the installation of the in-line electric switch.

For a person skilled in the art, the present invention is not limited to the details of the above exemplary embodiments, and the present invention can be implemented in other specific forms without departing from the spirit or basic features of the present invention. Therefore, the above embodiments should be considered as exemplary and non-limiting.

In addition, it should be understood that although the specification is described in terms of embodiments, not every embodiment includes only a single technical solution. This description of the specification is merely for the sake of clarity. Those skilled in the art should regard the specification as a whole, and the technical solutions in the embodiments can also be combined appropriately to form other embodiments that can be understood by those skilled in the art. However, the protection scope of the present invention is defined by the appended claims rather than the foregoing description, and it is therefore intended that all changes that fall within the meaning and scope of equivalency of the claims are included in the present invention and any reference signs in the claims should not be regarded as limiting the involved claims.

The invention claimed is:

1. An in-line switch assembly comprising:

a housing having a first housing part and a second housing part attachable together to form the housing;

two ports at different parts of the housing for insertion of an end of a power cord into the housing;

a conductor provided in each of the ports, each conductor having a piercing part;

a switching mechanism provided between the conductors of the respective ports for making and breaking electrical connection between the conductors; and a connection mechanism provided in each of the ports and adapted to receive an end of a power cord, operable to cause piercing of the piercing part through a sheath of the power cord and then electrical contact with a conductive core of the power cord, wherein the housing is configurable from a first state in which the first and second housing parts are partially attached together, thereby allowing insertion of an end of a power cord through each of the ports to the respective connection mechanism, to a second state in which the first and second housing parts are fully attached together, with an inserted end of a power cord being acted upon by the connection mechanism, wherein a positioning portion is provided in each of the ports, and is adapted to restrict lateral movement of the inserted end of a power cord, the positioning portion comprises a recess having a cross-section profile substantially complementary to a cross-section profile of the power cord, the recess is a U-shape channel having a center rib extending longitudinally, an aligning member is provided and configured to provide a biasing force to cause a wire within the power cord to abut against the center rib.

2. The in-line switch assembly according to claim 1, wherein the piercing part forms as an extension to the conductor.

3. The in-line switch assembly according to claim 1, wherein the connection mechanism comprises a plurality of pressing members arranged along a length of the inserted end of a power cord.

4. The in-line switch assembly according to claim 1, including a plurality of gripping members configured to apply pressure on the end of a power cord during the second state.

5. The in-line switch assembly according to claim 4, wherein the pressing members are oppositely and alternatively arranged on the first housing part and the second housing part.

6. The in-line switch assembly according to claim 4, wherein serrations are provided on each of the plurality of gripping members.

7. The in-line switch assembly according to claim 1, wherein the piercing part comprises at least one piercing portion configured to cause piercing of the sheath of the power cord.

8. The in-line switch assembly according to claim 1, wherein in the first state the first housing part being slidably movable with respect to the second housing part through a slidable engagement between a plurality of snap hooks arranged on the second housing part and a plurality of complementary elongated slots arranged on the first housing part.

9. The in-line switch assembly according to claim 1, wherein in the second state the first housing part is secured to the second housing part by an interference fit formed between a plurality of protrusions arranged on the first housing part and a plurality of complementary apertures arranged on the second housing part.

10. The in-line switch assembly according to claim 1, wherein a guard member is provided for each of the ports for blocking the end of said power cord from reaching further to the switching mechanism.

11. The in-line switch assembly according to claim 1, wherein the power cord is a twin-lead power cord.

12. The in-line switch assembly according to claim 11, wherein a divider is arranged in the positioning portion for separating a live wire and a neutral wire within the positioning portion.

13. The in-line switch assembly according to claim 1, wherein in the first state the first housing part is slidably movable with respect to the second housing part along a direction of coupling.

14. The in-line switch assembly according to claim 1, wherein the ports are positioned opposite each other.

15. The in-line switch assembly according to claim 1, wherein the in-line switch is a double-pole single throw switch.

16. The in-line switch assembly according to claim 1, wherein the switching mechanism comprises one of the following switches: a rocker switch, a tactile switch, a push-button switch, a slide switch, or a rotary switch.

* * * * *